US006321746B1

(12) United States Patent
Schneider et al.

(10) Patent No.: US 6,321,746 B1
(45) Date of Patent: Nov. 27, 2001

(54) PORTABLE HYPERBARIC CHAMBER

(75) Inventors: William C Schneider; James P. Locke, both of Houston; Horacio M De La Fuente, Friendswood, all of TX (US)

(73) Assignee: The United States of America as represented by the Administrator of the National Aeronautics and Space Adminstration, Washington, DC (US)

( * ) Notice: Subject to any disclaimer, the term of this patent is extended or adjusted under 35 U.S.C. 154(b) by 0 days.

(21) Appl. No.: 09/574,758

(22) Filed: May 17, 2000

(51) Int. Cl.[7] ..... A61G 10/00

(52) U.S. Cl. ..... 128/202.12; 128/205.26

(58) Field of Search ..... 128/200.24, 205.26, 128/205.28, 202.12–202.14, 745, 846, 201.27, 202.22; 600/21, 22; 482/13, 148; 405/186, 187

(56) References Cited

U.S. PATENT DOCUMENTS

| | | | | |
|---|---|---|---|---|
| Re. 36,958 | * | 11/2000 | Gamow | 128/202.12 |
| 3,316,828 | * | 5/1967 | Boehmer | 98/1.5 |
| 3,602,221 | | 8/1971 | Bleicken | 128/204 |
| 3,729,002 | | 4/1973 | Miller | 128/204 |
| 3,754,551 | | 8/1973 | Nielsen | 128/204 |
| 3,768,467 | * | 10/1973 | Jennings | 128/145 R |
| 3,877,427 | * | 4/1975 | Alexeev et al. | 128/204 |
| 4,011,867 | * | 3/1977 | Arntzen | 128/204 |
| 4,227,524 | | 10/1980 | Galerne | 128/205.26 |
| 4,467,798 | | 8/1984 | Saxon et al. | 128/205.26 |
| 4,509,513 | | 4/1985 | Lasley | 128/202.12 |
| 4,811,729 | * | 3/1989 | Sands et al. | 128/202.12 |
| 5,109,837 | | 5/1992 | Gamow | 128/202.12 |
| 5,255,673 | | 10/1993 | Cardwell et al. | 128/202.12 |
| 5,327,904 | | 7/1994 | Hannum | 128/205.26 |
| 5,360,001 | | 11/1994 | Brill et al. | 128/205.26 |
| 5,402,775 | * | 4/1995 | Reneau | 128/202.12 |
| 5,467,764 | | 11/1995 | Gamow | 128/202.12 |
| 5,582,574 | | 12/1996 | Cramer | 600/21 |
| 5,678,543 | | 10/1997 | Bower | 128/205.26 |
| 5,738,093 | | 4/1998 | Santi | 128/205.26 |
| 5,865,722 | * | 2/1999 | Heng | 600/21 |
| 5,935,516 | * | 8/1999 | Baugh | 422/1 |
| 6,016,803 | * | 1/2000 | Volberg et al. | 128/205.26 |
| 6,247,472 | * | 6/2001 | Moseley | 128/205.26 |

* cited by examiner

*Primary Examiner*—John G. Weiss
*Assistant Examiner*—Teena Mitchell
(74) *Attorney, Agent, or Firm*—Hardie R. Barr

(57) ABSTRACT

A portable, collapsible hyperbaric chamber. A toroidal inflatable skeleton provides initial structural support for the chamber, allowing the attendant and/or patient to enter the chamber. Oval hatches mate against bulkhead rings, and the hyperbaric chamber is pressurized. The hatches seal against an o-ring, and the internal pressure of the chamber provides the required pressure against the hatch to maintain an airtight seal. In the preferred embodiment, the hyperbaric chamber has an airlock to allow the attendant to enter and exit the patient chamber during treatment. Visual communication is provided through portholes in the patient and/or airlock chamber. Life monitoring and support systems are in communication with the interior of the hyperbaric chamber and/or airlock chamber through conduits and/or sealed feed-through connectors into the hyperbaric chamber.

20 Claims, 9 Drawing Sheets

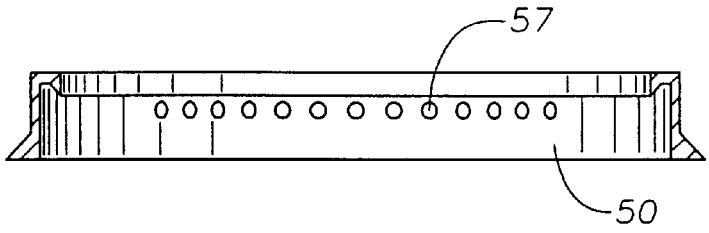
Fig. 6C
Fig. 7
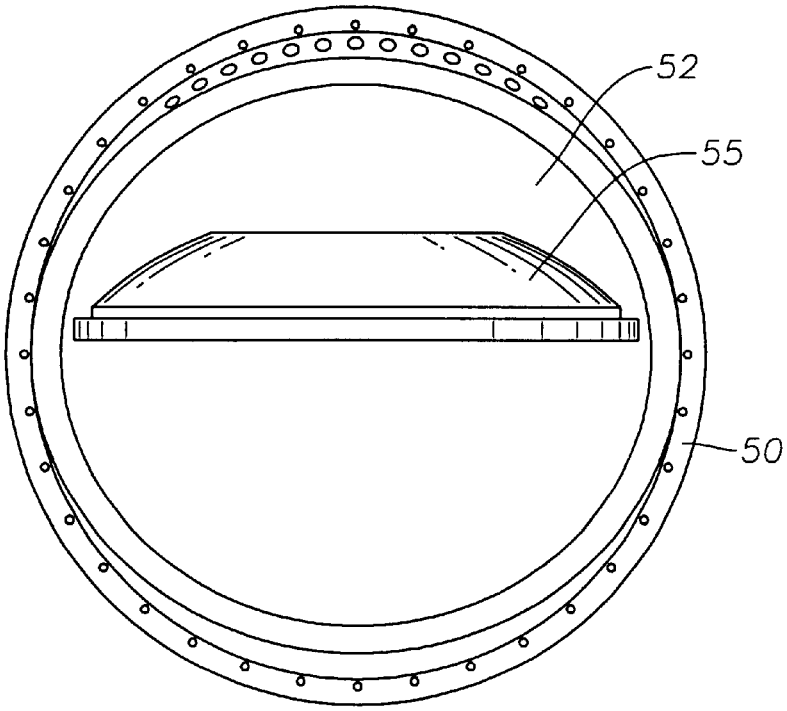
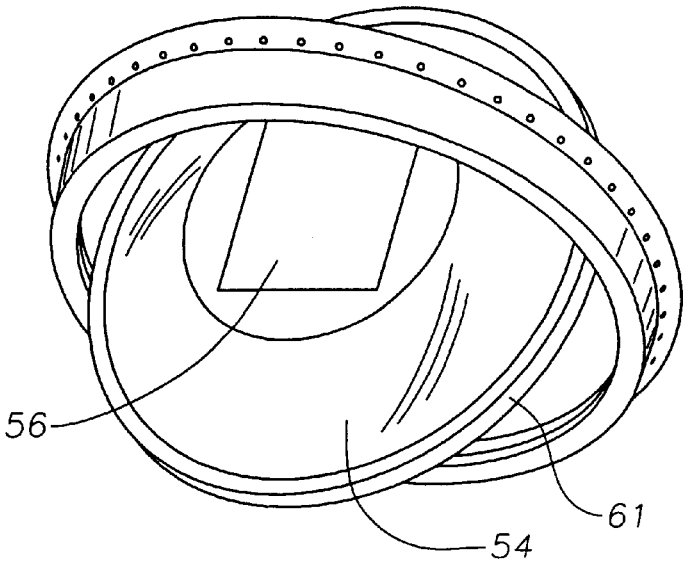
Fig. 8

PORTABLE HYPERBARIC CHAMBER

ORIGIN OF THE INVENTION

The invention described herein was made by employees of the United States Government and may be manufactured and used by or for the government of the United States of America for governmental purposes without the payment of any royalties thereon or therefor.

BACKGROUND OF THE INVENTION

1. Field of Invention

This invention relates to a hyperbaric chamber. Specifically, the invention describes a human hyperbaric chamber and airlock system that is lightweight, portable, stowable and collapsible. It provides the atmospheric pressures (over two atmospheres) required for standard hyperbaric medical treatments, including both hypobaric and hyperbaric decompression sickness. The device can be sized to contain at least one patient and attending medic(s).

2. Background Information and Related Art

Humans can experience altered atmospheric pressures in several environments (aviation, submarine operations, spacecraft, extravehicular space activities, scuba diving, etc.) Decompression sickness can develop under these conditions, occasionally leading to serious or fatal injury. Hyperbaric chambers are successfully used to treat decompression sickness.

Conventional hyperbaric chambers, made of solid metal, are heavy, have permanently high volume, and are not readily portable. For remote operational environments (International Space Station; civilian, commercial and military diving operations), conventional hyperbaric treatment chambers are often unavailable because of their lack of portability. A lightweight, portable, collapsible chamber would provide much-needed decompression sickness treatment capability in remote areas without great weight or stowage penalties. Currently, portable chamber designs exist, but often can not provide maximum standard therapy due to structural and pressure limitations. Their lack of an integral airlock prohibits access to the pressurized patient, thereby markedly decreasing the level of safety and treatment flexibility. Current portable chambers either have a permanent rigid skeleton (which dramatically increases storage volume), or lack internal support (which makes access extremely difficult and unpleasant when the chamber is not pressurized.) Many currently available collapsible chambers are sized for only one occupant (the patient), which limits the ability to treat and care for the patient.

Prior art for flexible hyperbaric chambers includes that described by Santi in U.S. Pat. No. 5,738,093. The present invention differs from the Santi patent in several important respects. First, in Santi the hatch is closed by rotating the hatch engaging threaded sectors. When pressurized, this places a heavy pressure load on the hatch threads, requiring the hatch and supporting structures to be very heavy. Second, the longitudinal and hoop straps supporting the chamber bladder are designed to have large spaces between the straps, requiring the chamber bladder to have a high strength and thickness in order to prevent billowing through the web spaces. Third, the straps are terminated at each end by looping the strap through a slot in a thin metallic fitting and stitching the strap onto itself. The thin metallic fittings are then bolted to the end rings. The slot in the thin metallic fitting forces the webbing to bend in a sharp radius that a) causes a high local stress in the straps, creating potential failure points and reducing the safety margins and b) creates high friction at the interface of the webbing and the thin metallic fitting, causing uneven load sharing between the outside of the loop and the inside of the loop. Fourth, the feed-through provisions for air, instrumentation wiring, pressurization etc. are located in the hatch itself, creating very cumbersome hatch operations due to the restrictive nature of the attached lines to the hatch.

Other examples of inflatable chambers include patents by Cardwell as disclosed in U.S. Pat. No. 5,255,673 and Bleiken in U.S. Pat. No. 3,602,221. Both devices lack any type of internal structural support before they are sealed and pressurized. Thus, when the patient is first placed in the collapsed device, part of the device is lying on top of him. These conditions make positioning the patient and equipment inside the device very difficult, poses a possible suffocation exposure, and can induce dangerous anxiety in claustrophobic individuals. Further, these and other typical prior art inflatable chambers are designed for only one occupant, making the presence of a medical attendant impossible.

The sealing systems for prior art inflatable chambers have various limitations. Some, such as disclosed by Miller in U.S. Pat. No. 3,729,002, use a zipper and seal system which is zipped and then reinforced by a loop and rod system inserted externally. Such a system creates high local stresses in the flexible fabric, which must therefore be heavy and bulky.

It would thus be a new and useful improvement to a portable hyperbaric chamber to accomplish the above-described purposes without the limitations of the prior art.

BRIEF SUMMARY OF THE INVENTION

Accordingly, the objectives of this invention are to provide, inter alia, a new and improved portable hyperbaric chamber that:

- is lightweight;
- is portable;
- is collapsible and flexible;
- can be stored flat with minimal volume;
- provides maximum standard hyperbaric treatment conditions for one patient and an attending medic;
- contains an integral airlock for access to the main chamber by personnel and/or equipment;
- includes conduits that provide air, medical oxygen, electrical power and communication to both the airlock and chamber;
- includes transparent viewports in both the airlock and chamber vessels;
- includes hatches that are lightweight and easily engaged and disengaged; and
- utilizes multilayer construction of flexible materials that provide an extremely sturdy pressure vessel.

These objectives are addressed by the structure and use of the inventive collapsible hyperbaric chamber. Due to the multilayer construction of flexible materials, the chamber collapses for flat storage with minimal volume, while maintaining a very sturdy pressure vessel capable of resisting punctures as well as internal pressures over four atmospheres. Equipment and personnel can be transferred into and out of the chamber via an integral inflatable airlock attached to the main inflatable chamber. The airlock chamber and main chambers are mated together by a main chamber hatch bulkhead. The main chamber hatch bulkhead includes passages for pressure lines, communication lines, medical oxygen and electrical power, each of which can be dedicated to either the airlock chamber or the main chamber.

The airlock chamber and main chamber each have an internal inflatable skeleton to maintain the chambers' volumes during the non-pressurized mode for ease of access without appreciably decreasing the living volume. Both chambers are constructed of an internal bladder within a restraint layer. The restraint layer is composed of flexible retaining straps running circumferentially and longitudinally around each chamber in a loose but contiguous weave. The internal bladder is oversized to allow the retaining straps to contain the force loads of the internal pressures of the chambers.

Other objects of the invention will become apparent from time to time throughout the specification hereinafter disclosed.

BRIEF DESCRIPTION OF THE DRAWINGS

FIGS. 6A–C depict the main interface ring.

FIG. 7 depicts the insertion of the hyperbaric chamber hatch through the main interface ring orifice.

FIG. 8 depicts the hyperbaric chamber hatch and main interface ring orifice in isometric view.

DETAILED DESCRIPTION OF THE INVENTION

Figure 1:
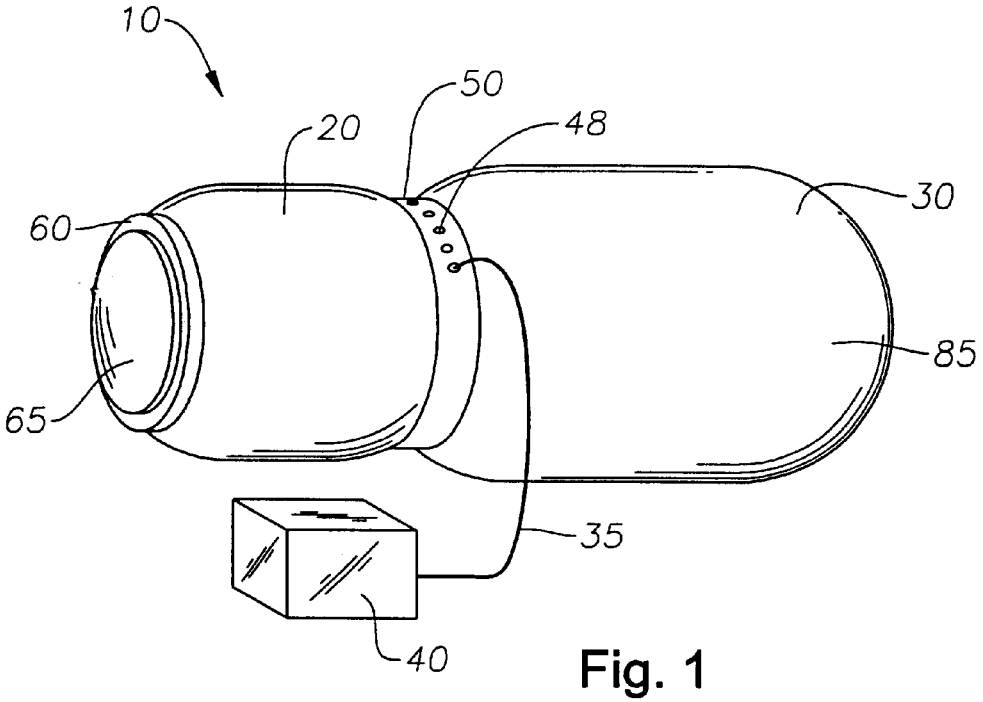
FIG. 1 depicts the inventive hyperbaric chamber and airlock.

The present invention is described as hyperbaric chamber 10. As shown in the preferred embodiment in FIG. 1, chamber 10 comprises an integral airlock chamber 20 and patient chamber 30. Airlock chamber 20 is sealed from the outside by airlock hatch 65, and patient chamber 30 is sealed by chamber hatch 55, shown in FIG. 2. External life support systems 40, including pressurized air supply/revitalization, power supply, communications lines, etc., are linked to hyperbaric chamber 10, for both airlock chamber 20 and patient chamber 30, by sealed umbilicals 35 passing through main interface ring apertures 48 in main interface ring 50, or by mating with sealed connectors (not shown) similarly located on interface ring 50.

Figure 2:
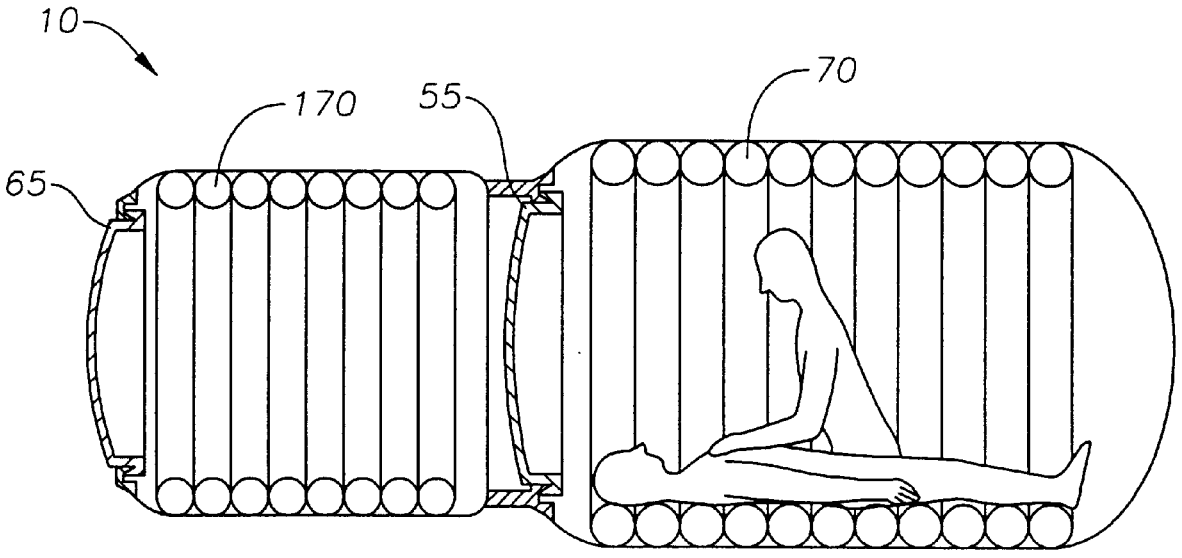
FIG. 2 depicts the inflatable skeleton of the hyperbaric chamber.

As seen in FIG. 2, airlock chamber 20 and patient chamber 30 each have airlock inflatable skeleton 170 and inflatable skeleton 70, respectively, which provide initial skeletal support prior to the introduction of internal air chamber pressure, which then maintains the shape and structure of hyperbaric chamber 10 during use. Inflatable skeleton 70 and airlock inflatable skeletons 170 are preferably a plurality of contiguous toroidal tubes, or alternatively a continuous helical tube, that define interior spaces for patient chamber 30 and airlock chamber 20. Inflatable skeleton 70 and airlock inflatable chamber 170 are preferably constructed of strong, flexible, air impermeable material such as rubber.

Figure 3:
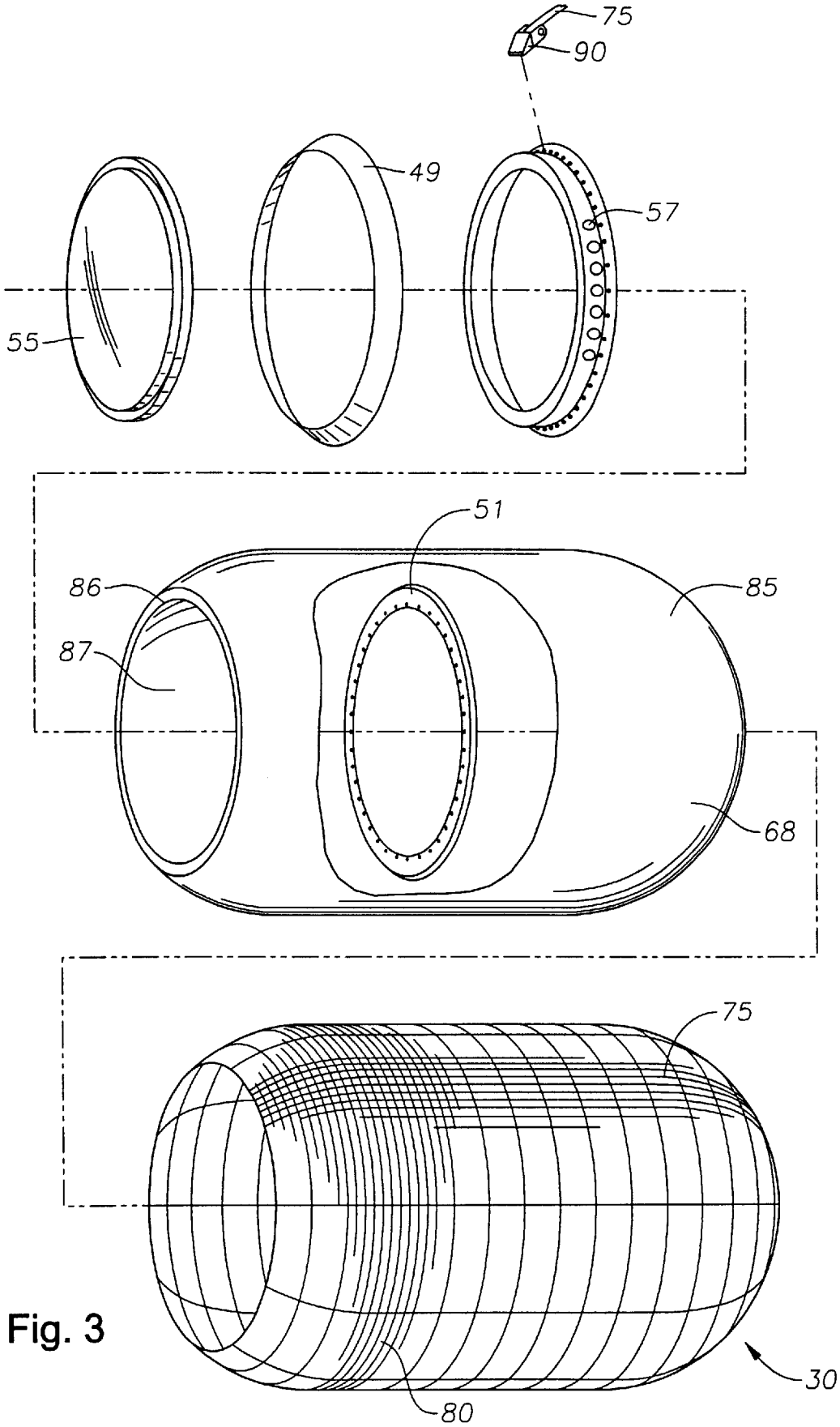
FIG. 3 depicts the main chamber of the hyperbaric chamber in exploded view.

The overall construction of patient chamber 30 is shown in exploded view in FIG. 3. The basic shape of patient chamber 30 is defined as a cylindrical ellipsoid by bladder 85, inflatable skeleton 70 (FIG. 2), longitudinal straps 75 and circumferential straps 80. The general shape is first defined by inflatable skeleton 70 (seen in FIG. 2), which is a plurality of contiguous toroidal tubes or a single helical tube secured to the interior of bladder 85. As inflatable skeleton 70 inflates, the lateral and longitudinal internal pressures of inflatable skeleton 70 against the interior of bladder 85 cause bladder 85, as well as longitudinal straps 75 and circumferential straps 80, to expand to a general cylindrical toroidal shape.

While inflatable skeleton 70 is depicted as interior to bladder 85, alternatively inflatable skeleton 70 can be an exoskeleton (not shown) attached to the exterior of bladder 85, and performing the same function by pulling bladder 85 open instead of pushing it open as shown in the preferred depiction.

As shown in FIG. 3, patient chamber 30 comprises bladder 85, which includes a bladder open end 87 and a bladder closed end 68. Bladder open end 87 provides an aperture for patient 96 (FIG. 12) and attendant 97 (FIG. 12) to enter and exit patient chamber 30. Bladder open end 87 has a bladder interior rim 86, which is secured, typically by mechanical fasteners, to main interface ring 50 by bladder clamp 51.

Figure 4:
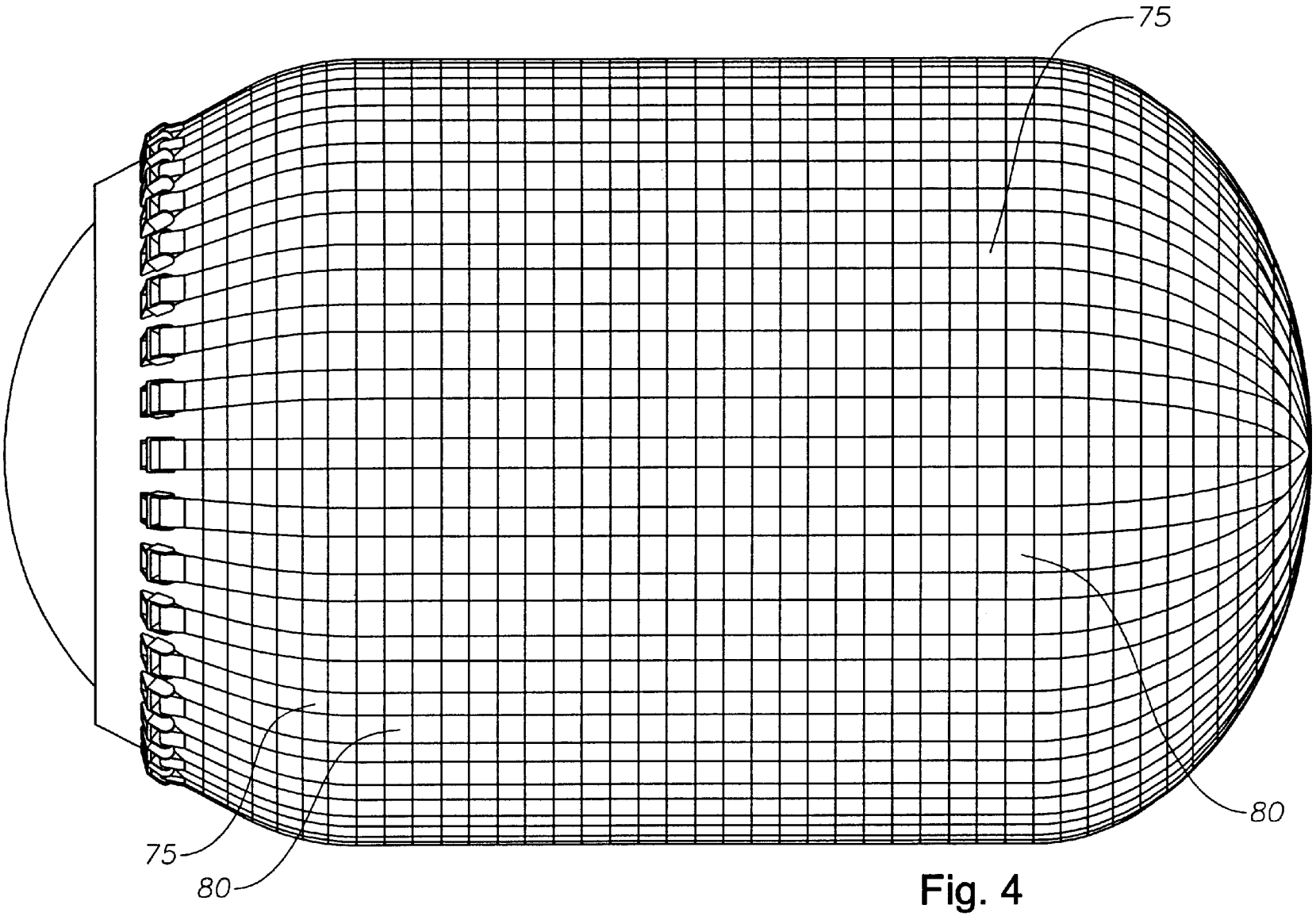
FIG. 4 depicts the cross weaving of the straps supporting the bladder of the main chamber.

Surrounding bladder 85 are longitudinal straps 75 and circumferential straps 80, both types of straps preferably being made of KEVLAR® or material with similar strength and flexibility characteristics. Circumferential straps 80 are preferably tightly cross-woven with longitudinal straps 80 as depicted in FIG. 4. By tightly cross weaving circumferential straps 80 with longitudinal straps 75 to form a tight weave, the internal pressure from bladder 85 is restrained by the tightly woven straps, rather than bladder 85 itself. This allows bladder 85 to be of material that is lighter and thinner, since it does not have to provide support for the outward forces of the internal pressure on bladder 85, thus allowing bladder 85 to be more flexible for storage.

Figure 5:
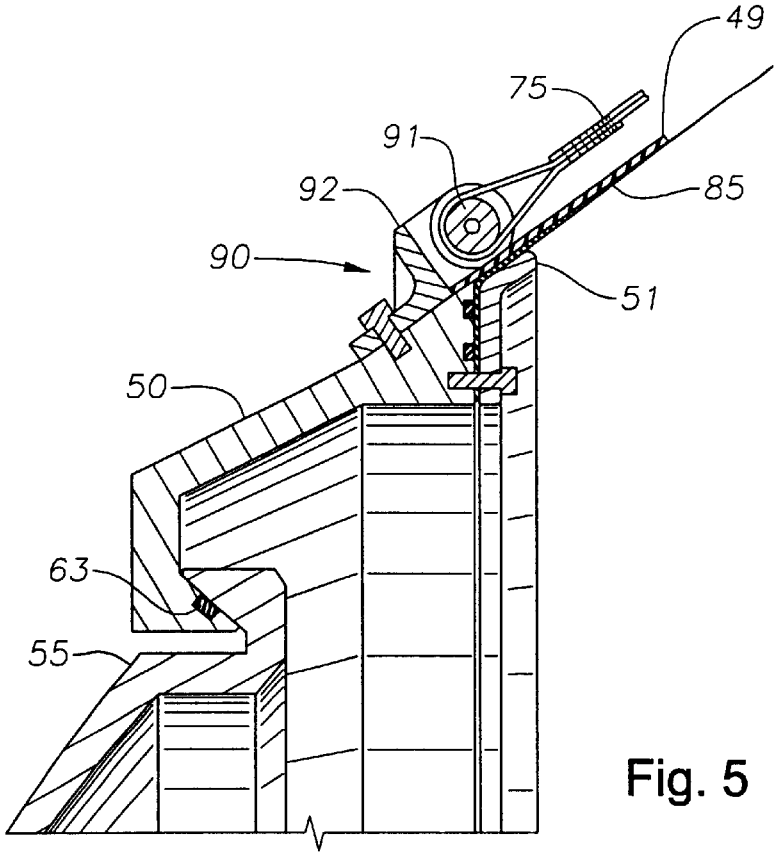
FIG. 5 depicts details of the straps roller attachments and hatch/hatch ring mating.
Figure 11:
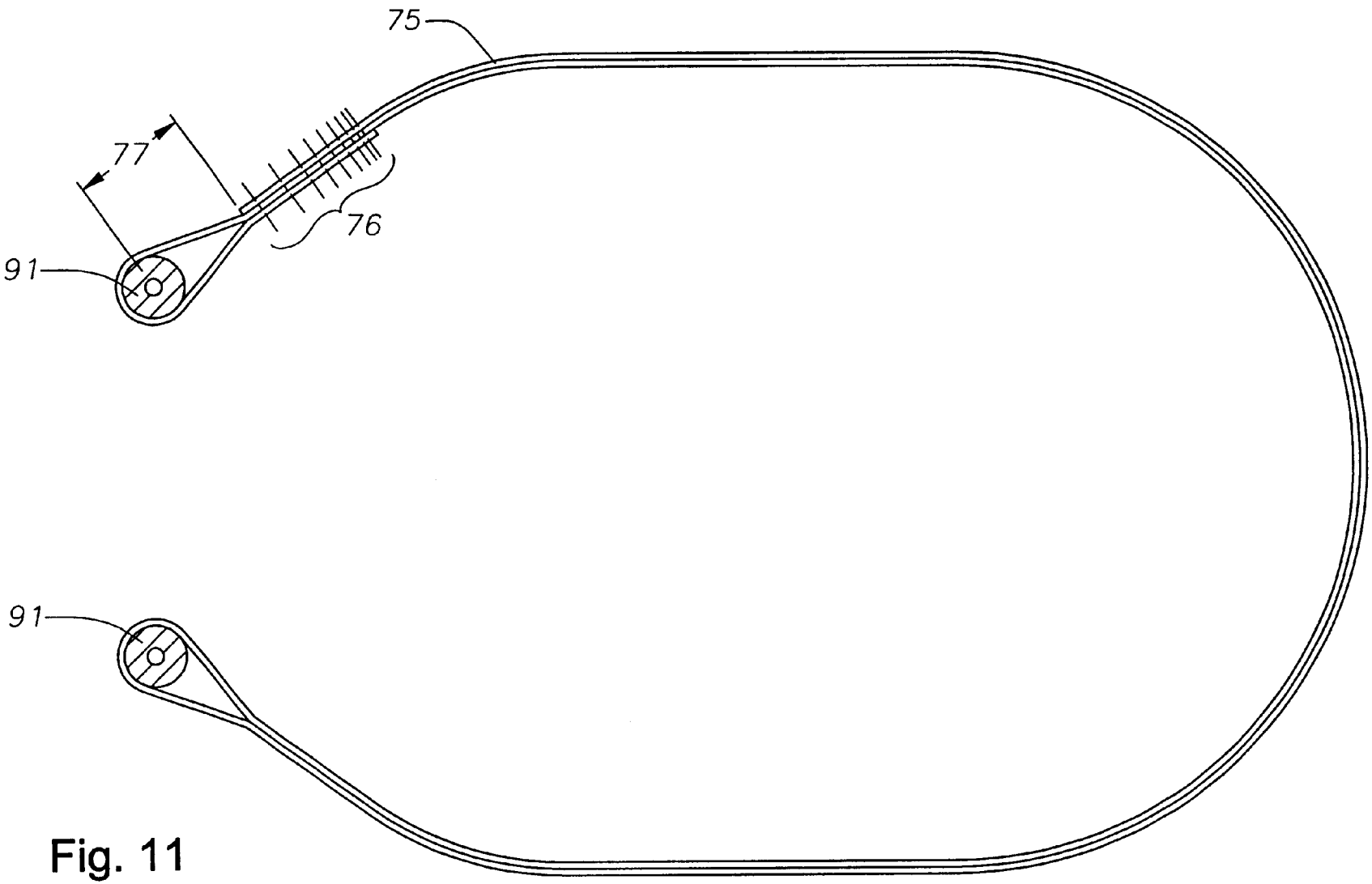
FIG. 11 depicts detail on the preferred embodiment of the support strapping around the chambers.

Longitudinal straps 75 are secured to main interface ring 50 with roller assemblies 90 as depicted in FIG. 5. Roller assembly 90 includes roller bracket 92, which holds roller 91. Roller bracket 92 is integral with, or is secured, typically with mechanical fasteners, to main interface ring 50. Longitudinal straps 75 preferably terminate in a loop that wraps around roller 91, thus minimizing edge strain against longitudinal strap 75. In the preferred embodiment, strap 75 is a single unit as depicted in FIG. 11. Each longitudinal strap 75 loops around a pair of rollers 91, each in the pair being located on opposite sides of main interface ring 50. Each longitudinal strap 75, as shown in FIG. 11, comprises a double layer except where it loops around each roller (single layer) and interlapping area 76 (triple layers). Each longitudinal strap 75 is stitched only in interlapping area 76, which comprises typically three overlapping layers of longitudinal strap 75. For each longitudinal strap 75, interlapping area 76 is located at a different distance 77 from roller 91, such that interlapping area 76 of longitudinal straps 75 are not in the same plane for any plane transverse to longitudinal straps 95. Thus the distance 77 between stitching area 76 and roller 91 is different, preferably at a uniform progression of distance, from any longitudinal strap 75 to the next longitudinal strap 75.

To protect bladder 85 from being cut or damaged by being rubbed by longitudinal straps 75, bladder buffer 49 is positioned intermediate bladder 85 and longitudinal straps 75. Typically, bladder buffer 49 has the shape of a narrow spherical frustum, as depicted in FIG. 3. Bladder buffer 49 is constructed of a flexible wear resistant material, such as reinforced rubber.

Figure 6A:
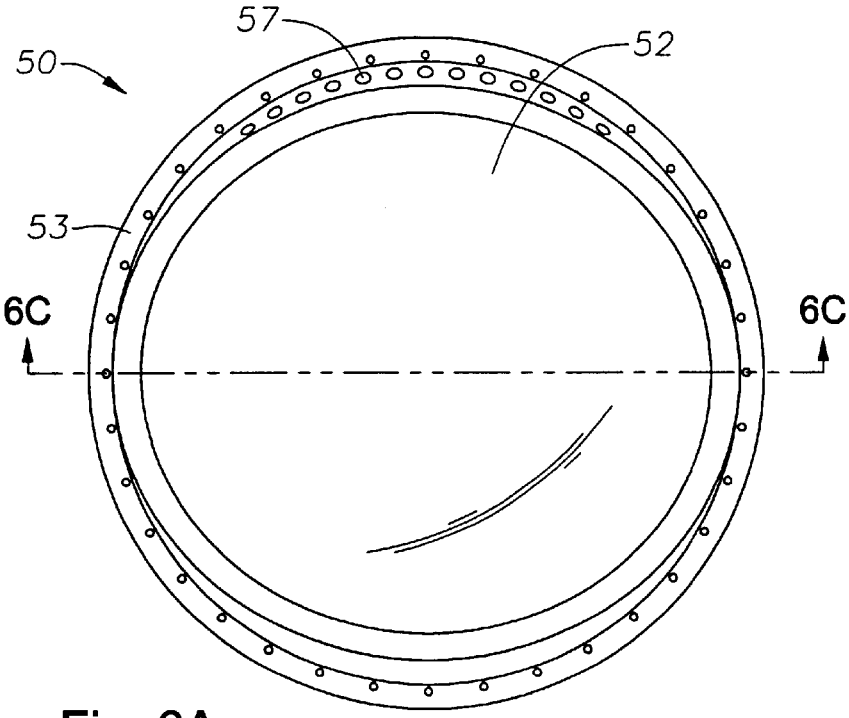
Figure 6B:
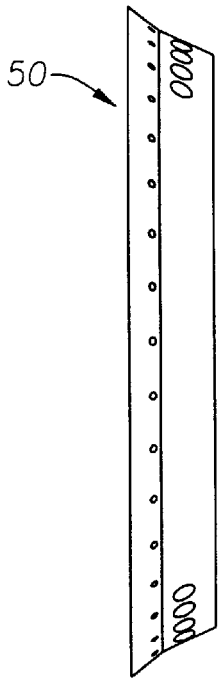

FIGS. 6A–C depict main interface ring 50, which acts as a bulkhead to the entrance of patient chamber 30. Main interface ring 50 includes a main interface ring outer rim 53, typically circular in shape. Interior to main interface ring 50 is ring elliptical orifice 52, having a minor axis and a major axis. Between main interface ring outer rim 53 and elliptical orifice 52 are conduits 57 (or alternatively sealed connectors, not shown), which provide passageways for sealed umbilicals 35 (or sealed connections for hoses, electrical connections and other system connectors) to the interiors of patient chamber 30 and airlock chamber 20.

Patient chamber hatch 55 is matable to main interface ring 50 to provide an airtight seal. As seen in FIG. 5, this seal is accomplished when patient chamber hatch 55 presses against O-ring 63, which is oriented in a channel in main interface ring 50. This pressing is accomplished when patient chamber 30 is pressurized, causing patient chamber hatch 55 to be pushed outward from the interior of patient chamber 30 against main interface ring 50. Prior to patient chamber 30 being pressurized, patient chamber hatch 55 is temporarily held in place on main interface ring 50 by a magnetic surface on patient chamber hatch 55 and/or main interface ring 50. The matching mating surface (main interface ring 50 or chamber hatch 55) is either a ferrous metal or having another magnetic surface capable of forming a magnetic bond. Thus either both mating surfaces of patient chamber hatch 55 and main interface ring 50 are magnetic, or one of the mating surfaces is magnetic while the other is a ferrous metal capable of being magnetically attracted by the matching magnetic surface.

As seen in FIG. 7, main interface ring 50 includes a ring elliptical orifice 52 having a major axis and a minor axis. Patient chamber hatch 55 has a hatch rim ellipse having its own major axis and minor axis. The minor axis of patient chamber hatch 55 is smaller than the major axis of ring elliptical orifice 52. Therefore, by rotating patient chamber hatch 55 by 90° in the X-axis and Z-axis, it is able to be passed through ring elliptical orifice 52. Once through, patient chamber hatch 55 is rotated back so that its major and minor axes are aligned with the major and minor axes of ring elliptical orifice 52 for mating of patient chamber hatch 55 and main interface ring 50.

Patient chamber hatch 55 can be constructed of rigid material such as plastic or metal, or in the preferred embodiment has a flexible patient chamber hatch face 54. In the preferred embodiment, patient chamber hatch face 54 is constructed of a flexible but strong airtight material that is bonded or attached to hatch rim ellipse 61, as seen in FIG. 8. Optionally, an interior patient viewport 56 is constructed within patient chamber hatch face 54 to provide visual communication with the interior or patient chamber 30. When constructed of flexible material, patient chamber hatch face 54 can be reinforced with interwoven or adjacent strapping to provide additional retention strength against the air pressure from the interior of patient chamber 30 when pressurized.

Figure 9:
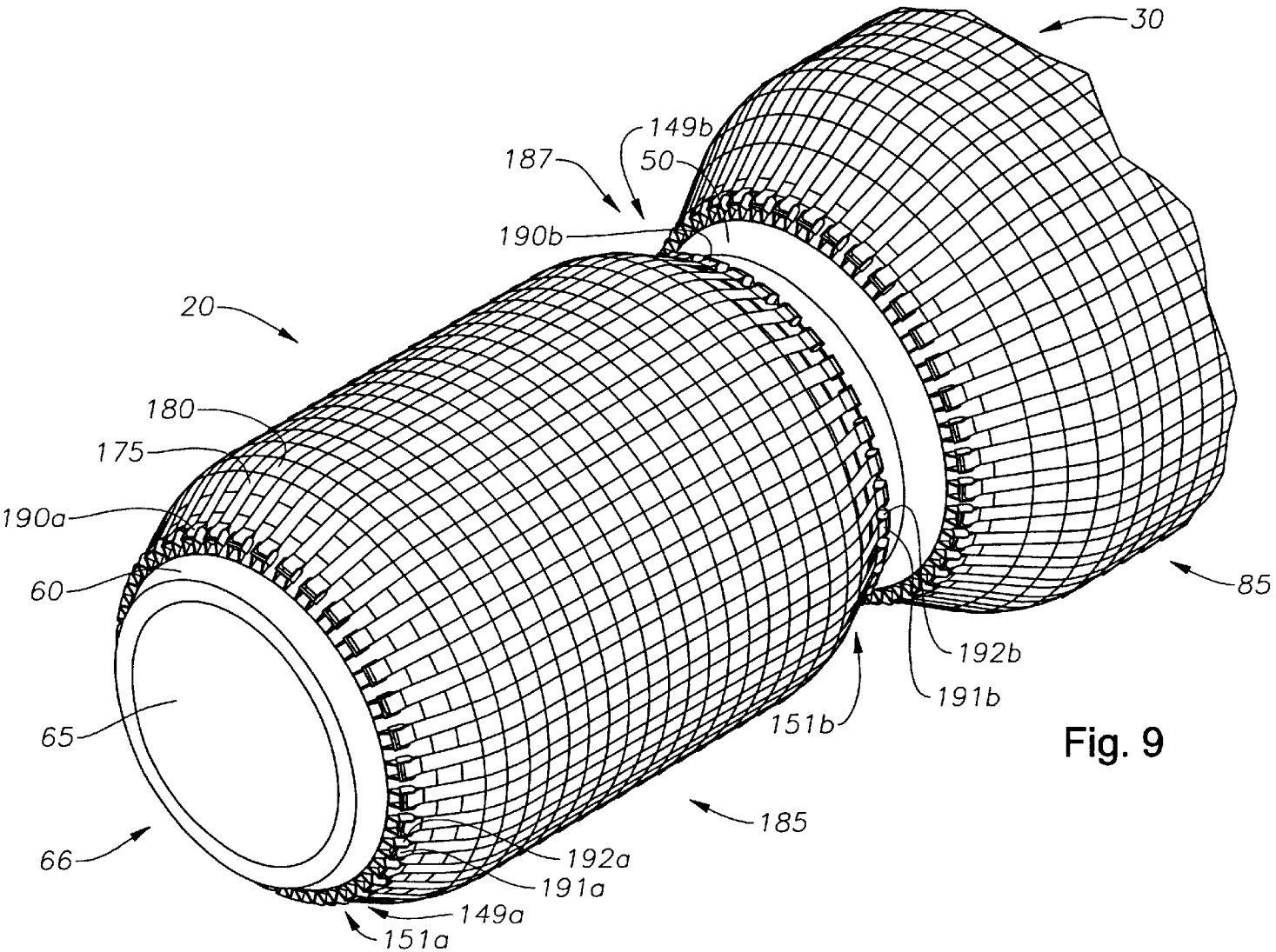
FIG. 9 depicts the airlock chamber of the hyperbaric chamber.

In the preferred embodiment, hyperbaric chamber 10 includes an airlock chamber 20 attached to patient chamber 30. As seen in FIG. 9, the construction of airlock chamber 20 is analogous to that of patient chamber 30. Airlock bladder 185 is surrounded by airlock longitudinal straps 175 and airlock circumferential straps 180. Airlock bladder 185 has two open ends, airlock entrance open end 66 and airlock interface open end 187. Airlock entrance open end 66 mates to airlock hatch ring 60 by being clamped between airlock bladder clamp 151*a* and airlock hatch ring 60. Secured to airlock hatch ring 60 are a plurality of airlock roller assemblies 190*a*, comprising airlock rollers 191*a* and airlock roller brackets 192*a*. Airlock longitudinal straps 175 loop around airlock rollers 191*a* to minimize cutting tension as described above for longitudinal straps 75 of patient chamber 30. Airlock longitudinal straps 175 are stitched and looped in an analogous manner as described above for longitudinal straps 75. Airlock circumferential straps 180 tightly interweave between airlock longitudinal straps 175 to provide pressure support of airlock bladder 185, in a manner analogous to that described above for bladder 85 of patient chamber 30.

Figure 10:
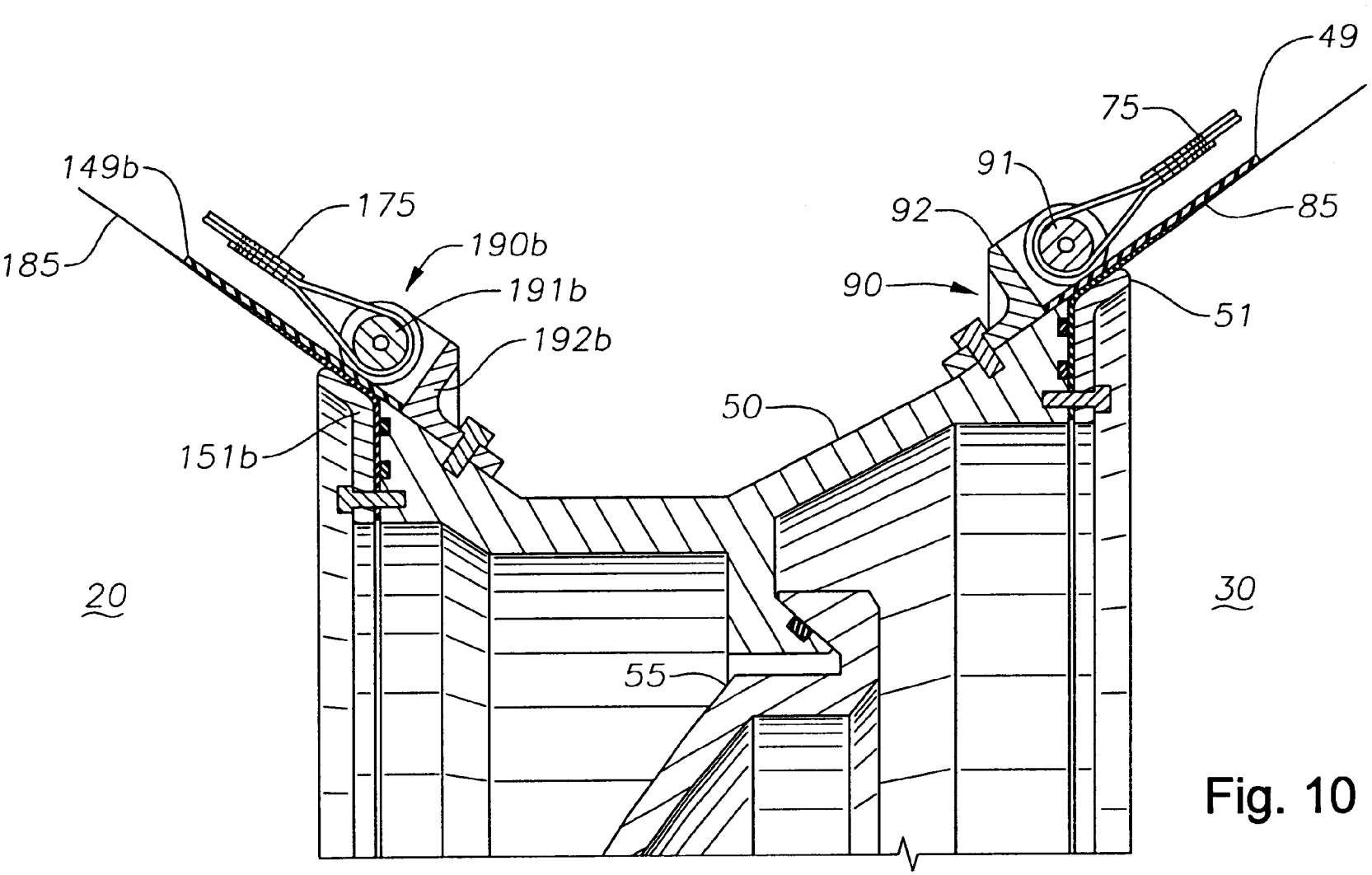
FIG. 10 depicts main interface ring when designed for an attaching airlock chamber.

Airlock chamber 20 attaches to main interface ring 50 as depicted in FIG. 10. Airlock bladder 185 is clamped to main interface ring 50 by airlock bladder clamp 151*b*, which pushes against O-rings in the side of main interface ring 50 as depicted. To protect airlock bladder 185 from airlock roller bracket 192*b* and airlock longitudinal straps 175, airlock bladder buffer 149 is positioned exterior airlock bladder 185 at the area of interface shown in FIG. 10.

Airlock bladder 185 is clamped at airlock entrance open end 66 to airlock hatch ring 60, as seen in FIG. 9. Airlock bladder 185 is clamped to airlock hatch ring 60 with airlock bladder clamp 151*a* against O-rings in airlock hatch ring 60 in a manner analogous to that described above for the bladder attachments to main interface ring 50. Protection is further provided by airlock bladder buffer 149*a* between airlock roller assemblies 190*a* and airlock longitudinal straps 175 in a manner similar to that described above at main interface ring 50.

Airlock hatch 65 mates with airlock hatch ring 60 in the manner described above for mating patient chamber hatch 55 and main interface ring 50.

OPERATION

In the preferred embodiment, hyperbaric chamber 10 is stowed in a storage area of a room, ship, spacecraft or other area where space is limited. When deflated, hyperbaric chamber 10 collapses into a relatively small shape.

To prepare hyperbaric chamber 10 for use, bladder 85 and airlock bladder 185 are loosely stretched out. Inflatable skeleton 70 and airlock inflatable skeleton 170 are pressurized and inflated using a standard air pump. As they inflate, they provide a general shape to patient chamber 30 and airlock chamber 20. Attendant 97 is now able to assist patient 96 into patient chamber 30 by crawling through airlock hatch ring 60, airlock chamber 20 and main interface ring 50. Life function monitor leads are attached to patient 96, said leads typically connected via hard wire to remote monitor equipment outside hyperbaric chamber 10. Attendant 97 then positions airlock hatch 65 against airlock hatch ring 60, which are aligned by magnets on the surface of airlock hatch 65 and/or airlock hatch ring 60. Both patient chamber 30 and airlock chamber 20 are pressurized by an air pump of external life support systems 40. When patient chamber 30 and airlock chamber 20 are pressurized above 1.0 atmospheres, airlock hatch 65 presses against O-ring 163, creating an airtight seal.

When attendant 97 desires to leave hyperbaric chamber 10, he aligns patient chamber hatch 55 with main interface ring 50. The pressure in airlock chamber 20 is bled off, creating a pressure gradient between patient chamber 30 (positive pressure) and airlock chamber 20 (neutral pressure). This pressure gradient now forces patient chamber hatch 55 against main interface ring 50 and its O-ring 63, creating an airtight seal inside patient chamber 30. To exit airlock chamber 20, attendant 97 removes airlock hatch 65, rotates it 90° in the X-axis and Z-axis such that the minor axis of airlock hatch 65 is able to pass through the major axis of airlock hatch ring 60.

Figure 12A:
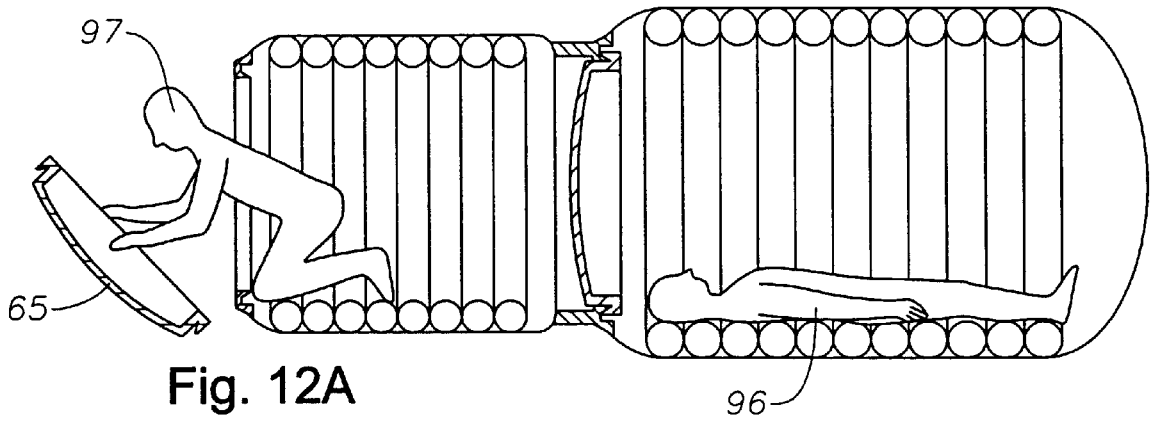
FIGS. 12A–C depict the sequence of personnel entry into the hyperbaric chamber.
Figure 12B:
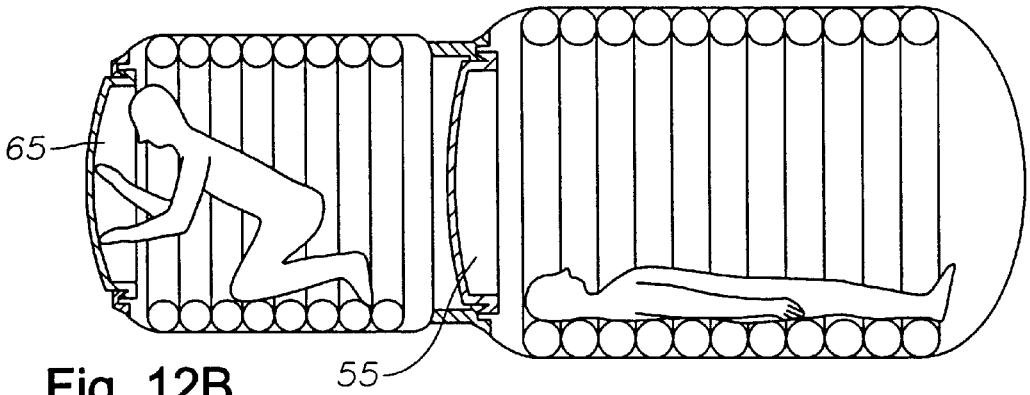
Figure 12C:
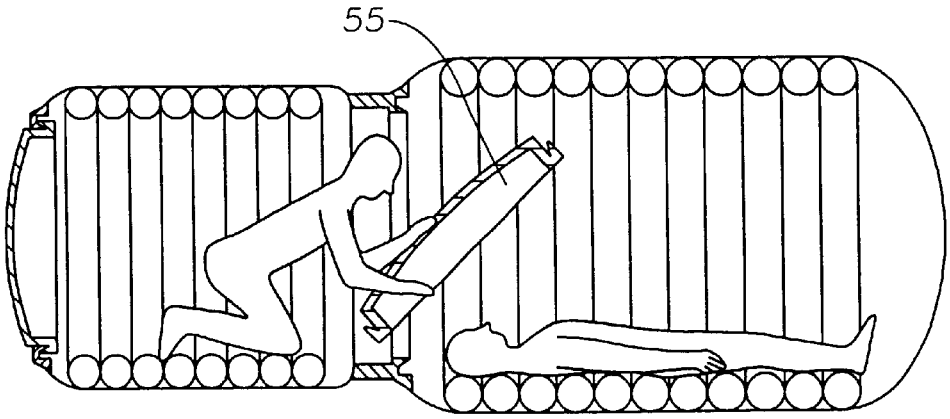

Entry by attendant 97 is depicted in FIGS. 12A through 12C. In FIG. 12A, attendant 97 crawls into airlock chamber 20, and pulls airlock hatch 65 in through airlock hatch ring 60 by aligning the minor and major axes of airlock hatch 65 and hatch ring 60. In FIG. 12B, attendant 97 positions airlock hatch 65 against airlock hatch ring 60 aligned along their major and minor axes, such that they are mated by magnetic force. Airlock chamber 20 is pressurized until at the same pressure of patient chamber 30. This forces airlock hatch to seal against airlock hatch ring 60 and its airlock O-ring 163. Patient chamber hatch 55 is now no longer providing an airtight seal to patient chamber 30, since there is no longer pressure against it from the interior of patient chamber 30. As seen in FIG. 12C, attendant 97 is now able to break the magnetic seal between patient chamber hatch 55 and main interface ring 50, and push patient chamber hatch 55 into patient chamber 30 to allow entry into patient chamber 30.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

We claim:

1. A portable hyperbaric chamber, comprising:

a patient chamber;

said patient chamber comprising a bladder;

said bladder comprising a closed end and an open end;

said open end of said bladder having a bladder interior rim;

a plurality of longitudinal straps surrounding said bladder;

a plurality of circumferential straps surrounding said bladder;

an inflatable skeleton adjacent said bladder;

a main interface ring attached to said bladder interior rim; and a patient chamber hatch capable of mating with said main interface ring for providing a seal when said patient chamber is pressurized.

2. A hyperbaric chamber as in claim 1, wherein:

said longitudinal straps attach to a plurality of rollers; and said plurality of rollers attach to a plurality of roller brackets on said main interface ring.

3. A hyperbaric chamber as in claim 1, wherein said inflatable skeleton comprises a continuous helical tube secured to an interior wall of said bladder.

4. A hyperbaric chamber as in claim 1, wherein said inflatable skeleton comprises a plurality of contiguous toroidal tubes secured to an interior wall of said bladder.

5. A hyperbaric chamber as in claim 1, wherein said bladder interior rim is secured between said main interface ring and a bladder clamp.

6. A hyperbaric chamber as in claim 1, wherein:

said patient chamber hatch having a patient chamber hatch elliptical shape;

said patient chamber hatch elliptical shape having a hatch minor axis and a hatch major axis;

said main interface ring having a main interface ring elliptical shape;

said main interface ring elliptical shape having a ring minor axis and a ring major axis;

said hatch minor axis being smaller than said ring major axis; wherein said patient chamber hatch is insertable through said main interface ring by rotating said patient chamber hatch such that said hatch minor axis is roughly aligned with said ring major axis.

7. A portable hyperbaric chamber as in claim 6, wherein said patient chamber hatch and said main interface ring are magnetically adhered when said hatch major axis and said ring major axis are aligned.

8. A portable hyperbaric chamber as in claim 1, said main interface ring further comprising at least one aperture;

said at least one aperture providing passage for at least one sealed umbilical connection from at least one external life support system to an interior of said patient chamber.

9. A portable hyperbaric chamber as in claim 1, further comprising:

an airlock chamber;

said airlock chamber comprising an airlock bladder;

said airlock bladder comprising an airlock interface open end and an airlock entrance open end;

said airlock interface open end attaching to said main interface ring;

said airlock entrance open end comprising an airlock bladder entrance interior rim;

said airlock bladder entrance interior rim attaching to an airlock hatch ring;

a plurality of airlock longitudinal straps surrounding said airlock bladder;

a plurality of airlock circumferential straps surrounding said airlock bladder;

an inflatable airlock skeleton adjacent said airlock bladder; and an airlock hatch capable of mating with said airlock hatch ring for providing a seal when said airlock chamber is pressurized.

10. A hyperbaric chamber as in claim 9, wherein:

said airlock longitudinal straps attach to a plurality of airlock rollers;

said plurality of airlock rollers attach to a plurality of airlock roller brackets; and said plurality of airlock roller brackets attach to said airlock hatch ring.

11. A hyperbaric chamber as in claim 9, wherein said inflatable airlock skeleton comprises a continuous airlock toroidal tube secured to an interior wall of said airlock bladder.

12. A hyperbaric chamber as in claim 10, wherein said airlock bladder is secured between said airlock hatch ring and an airlock bladder clamp.

13. A hyperbaric chamber as in claim 10, wherein:

said airlock hatch having an airlock hatch elliptical shape;

said airlock hatch elliptical shape having an airlock hatch minor axis and an airlock hatch major axis;

said airlock hatch ring having an airlock hatch ring elliptical shape;

said airlock ring elliptical shape having an airlock hatch ring minor axis and an airlock hatch ring major axis;

said airlock hatch minor axis being smaller than said airlock ring major axis; wherein said airlock hatch is insertable through said airlock hatch ring by rotating said airlock hatch such that said airlock hatch minor axis is roughly aligned with said airlock ring major axis.

14. A portable hyperbaric chamber as in claim 13, wherein:

said airlock hatch comprising a magnetic surface;

said airlock hatch ring having a metal surface; wherein said airlock hatch and said airlock hatch ring are magnetically adhered when said airlock hatch major axis and said airlock ring major axis are aligned.

15. A portable hyperbaric chamber as in claim 8, wherein said at least one aperture providing passage for at least one umbilical connection from at least one life support system to an airlock chamber.

16. A portable hyperbaric chamber as in claim 2, wherein each of said plurality of longitudinal straps comprise a single strap, said single strap looping around an opposing pair of rollers from said plurality of rollers.

17. A portable hyperbaric chamber as in claim 16, wherein said single strap being formed by stitching an overlapping area of said strap.

18. A method of using a portable hyperbaric chamber, said method comprising:

inflating a patient chamber with an inflatable skeleton, said patient chamber comprising a bladder;

connecting at least one umbilical connected to at least one external life support system to an interior of said patient chamber;

placing a patient inside said patient chamber;

mating a patient chamber hatch to a main interface ring, said main interface ring attaching to said bladder of said patient chamber;

pressurizing said patient chamber with pressurized air from said external life support systems, said pressure pressing said patient chamber hatch against said main interface ring to form a seal to hold said pressurized air in said patient chamber; and communicating with and monitoring vital signs of said patient within said patient chamber via said external life support systems.

19. A method as in claim 18, further comprising:

inflating an airlock chamber with an airlock inflatable skeleton, said airlock chamber comprising an airlock bladder, said airlock bladder comprising an airlock interface open end and an airlock entrance open end, said airlock interface open end attaching to said main interface ring of said patient chamber, said airlock entrance open end attaching to an airlock hatch ring;

connecting at least one airlock umbilical to an interior of said airlock chamber, said at least one airlock umbilical connected to at least one external life support system;

mating an airlock hatch to an airlock hatch ring;

pressurizing said airlock chamber with pressurized air from said external life support systems, said pressure pressing said airlock hatch against said airlock hatch ring to form a seal to hold said pressurized air in said airlock chamber;

removing said patient chamber hatch when said airlock chamber pressure and said patient chamber pressure are equal for ingress and egress between said patient chamber and said airlock chamber.

20. A method as in claim 18, further comprising:

mating said patient chamber hatch against said main interface ring;

reducing air pressure in said airlock chamber to outside ambient air pressure, wherein a seal is formed between said patient chamber hatch and said main interface ring, said seal formed by pressure against said patient chamber hatch against said interface ring; and removing said airlock hatch for egress from said airlock chamber.

* * * * *